US005540052A

United States Patent [19]

Sieke et al.

[11] Patent Number: 5,540,052

[45] Date of Patent: Jul. 30, 1996

[54] PULSE HYDRAULIC SYSTEMS AND METHODS THEREFOR

[76] Inventors: Ingrid D. Sieke; Harold B. Sieke; Helmut K. Sieke, all of 1030 Sandretto Dr., Prescott, Ariz. 86301

[21] Appl. No.: 291,122

[22] Filed: Aug. 16, 1994

[51] Int. Cl.[6] ..... F15B 7/02

[52] U.S. Cl. ..... 60/540; 60/371

[58] Field of Search ..... 60/371, 538, 540; 138/31

[56] References Cited

U.S. PATENT DOCUMENTS

| | | | |
|---|---|---|---|
| 2,802,336 | 8/1957 | Ball | 60/371 |
| 2,980,079 | 4/1961 | Joelson | 60/371 |
| 3,213,615 | 10/1965 | Bjornberg | 60/371 |
| 4,407,150 | 10/1983 | Kelly | 60/540 |
| 4,881,725 | 11/1989 | Shoida et al. | 138/31 |

FOREIGN PATENT DOCUMENTS

| | | | |
|---|---|---|---|
| 722437 | 11/1965 | Canada | 138/31 |

*Primary Examiner*—F. Daniel Lopez

*Attorney, Agent, or Firm*—Harry M. Weiss; Jeffrey D. Moy; Harry M. Weiss & Associates, P.C.

[57] ABSTRACT

A pulse hydraulic system is disclosed comprising, in combination a hydraulic sump for supplying the system with hydraulic fluid, one or more hydraulic pumps taking suction on the sump for increasing the pressure of the hydraulic fluid exiting the sump, a pulse generator fed by the discharge from the pump(s) for creating pulsed pressure of the hydraulic fluid output therefrom, an actuator coupled to the pulse generator for doing work, and one or more accumulators coupled between at least one of the pump(s) and the pulse generator, between the pulse generator and the actuator, and between the pulse generator and the sump for storing and supplying pressurized hydraulic fluid to the system. The addition of one or more pulse intensifiers to a pulse hydraulic system increases the overall system efficiency.

30 Claims, 3 Drawing Sheets

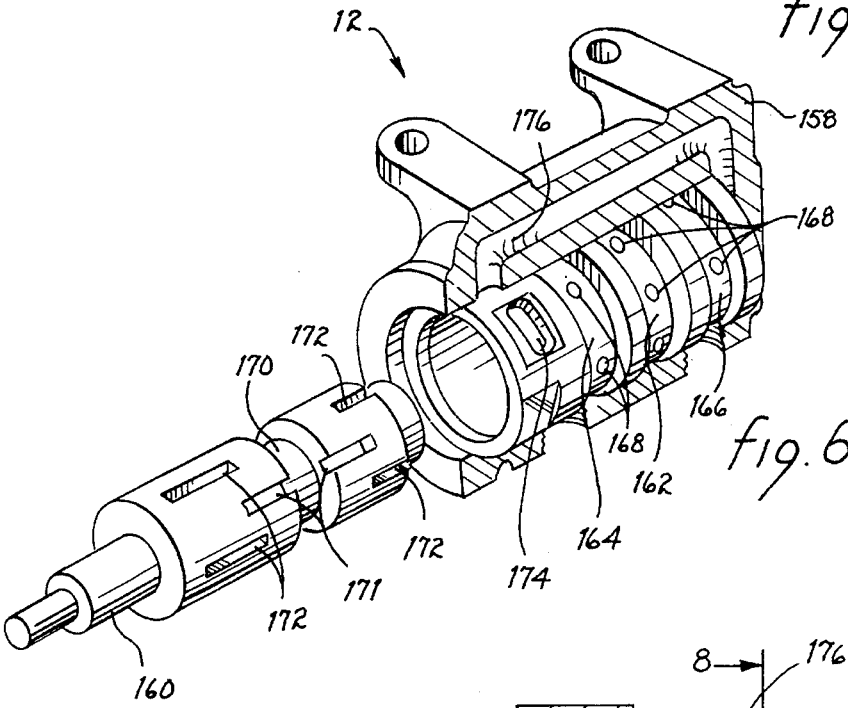
fig. 6
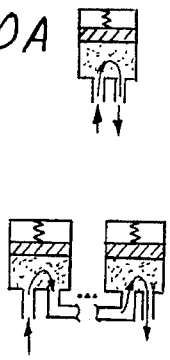
fig. 10A
fig. 10B
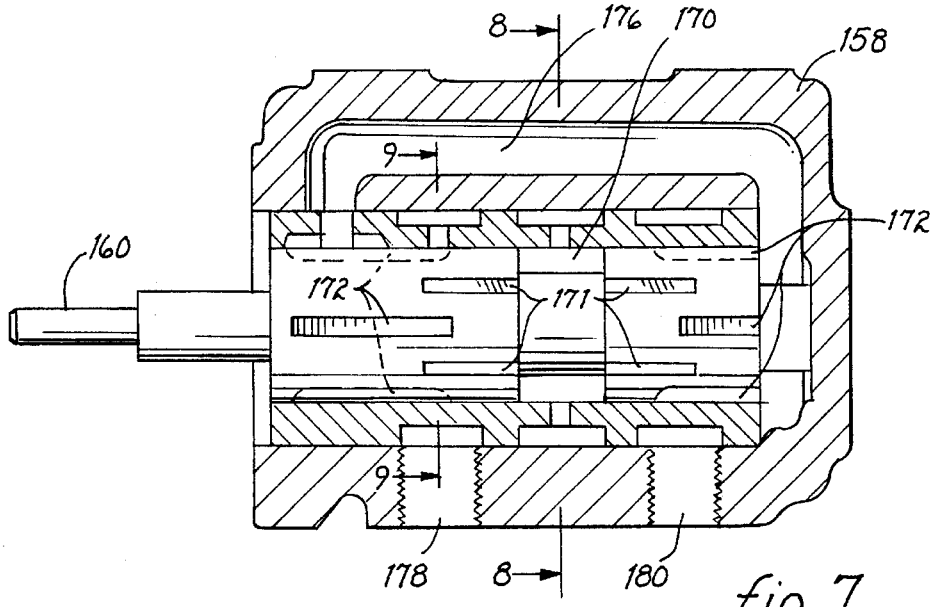
fig. 7
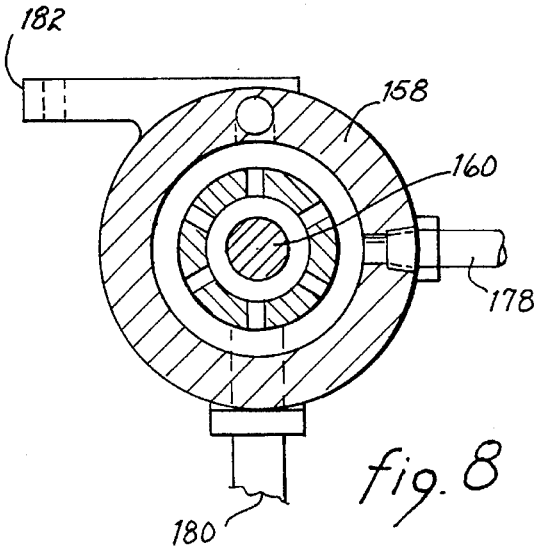
fig. 8
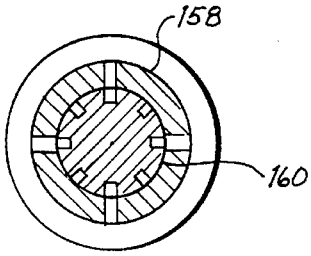
fig. 9

PULSE HYDRAULIC SYSTEMS AND METHODS THEREFOR

RELATED PATENT

U.S. Pat. No. 4,556,174, entitled "APPARATUS FOR TREATING DISPERSIONS AND THE LIKE WITH NON-SINUSOIDAL VIBRATION," filed in the name of the same inventor is hereby incorporated herein by reference.

BACKGROUND OF THE INVENTION

1. Field of the Invention

This invention relates generally to hydraulic systems and, more specifically, to pulse hydraulic systems including one or more pulse intensifiers and methods therefor.

2. Description of the Related Art

U.S. Pat. No. 4,556,174 discloses a pulse hydraulic system and the method of operation thereof. The performance of such a pulse hydraulic system depends, in pertinent part, upon the flow rate and the pressure of the hydraulic fluid flowing through the pulse generator to the actuator. Without re-stating the full operation of the pulse generator disclosed in U.S. Pat. No. 4,556,174, the following brief description is provided in order to demonstrate a limitation of such a pulse generator. In general, the pulse generator has a series of chambers. One chamber is provided with pressurized hydraulic fluid from the discharge of a hydraulic pump. Two or more other chambers transfer the pressurized hydraulic fluid from the first chamber of the pulse generator to the actuator. One of these two chambers supplies pressurized pulses of hydraulic fluid to the actuator, and the other of these two chambers provides a return flow path for pressurized hydraulic fluid from the actuator to a hydraulic sump. The pulse generator is provided with a rotor having a series of cavities. As the rotor rotates, the two "other" chambers are alternatively aligned to be the supply and then the return path for the actuator due to the relative position between the cavities in the rotor and a series of apertures in each of the chambers. Furthermore, as the rotor rotates, the flow paths are established and, temporarily blocked by closed portions of the rotor. The frequency of the pressurized, hydraulic fluid pulses is a function of the rotational velocity of the rotor. When the rotor temporarily closes off flow paths, the discharge pressure of the pump is not used to perform work. In other words, when the flow paths necessary to deliver pressurized fluid to the actuator, where the work output of the system is executed, are temporarily closed, and the pump is still running, the energy needed to provide the pressurized output from the pump is unnecessarily wasted. If there were some special way to store the pressurized hydraulic fluid from the pump discharge when the flow paths from the pulse generator to the actuator are temporarily closed, and then return this stored, pressurized hydraulic fluid to the system, then overall system performance and efficiency would increase substantially.

Therefore, there existed a need to provide a pulse hydraulic system having one or more accumulators to store and subsequently return this pressurized hydraulic fluid to the system.

SUMMARY OF THE INVENTION

In accordance with one embodiment of this invention, it is an object of this invention to provide a pulse hydraulic system including one or more accumulators.

It is another object of this invention to provide a method for operating a pulse hydraulic system including one or more accumulators.

It is a further object of this invention to provide a pulse hydraulic system including one or more pulse intensifiers and one or more hydraulic pumps.

It is a yet another object of this invention to provide a pulse hydraulic system including one or more accumulators and a hydraulic actuator, a hydraulic motor, or one or more spray nozzle for doing work.

BRIEF DESCRIPTION OF THE PREFERRED EMBODIMENTS

In accordance with one embodiment of this invention, a pulse hydraulic system is disclosed comprising, in combination, hydraulic fluid storage means for supplying the system with hydraulic fluid, pressurizing means coupled to the hydraulic fluid storage means for increasing pressure of the hydraulic fluid exiting from the hydraulic fluid storage means into the pressurizing means, pulse generating means coupled to the pressurizing means for creating pulsed pressure of hydraulic fluid output therefrom, actuator means coupled to at least one line of the pulse generating means and supplied with the hydraulic fluid from the pulse generating means for doing work, and accumulator means coupled between at least one of the pressurizing means and the pulse generating means, between the pulse generating means and the actuator means, and between the pulse generating means and the hydraulic fluid storage means for storing and supplying pressurized hydraulic fluid to the system. The pulse generating means comprises cylindrical member means having a hollow, interior, cylindrical cavity and having a plurality of separate, grooved, exterior surface portions having a plurality of apertures there through for providing at least one chamber means for receiving hydraulic fluid from the pressurizing means, second chamber means for supplying the pulsed pressure hydraulic fluid to the actuator means, and third chamber means for returning the hydraulic fluid from the actuator means to the hydraulic fluid storage means via the pulse generating means, rotor means inserted within the hollow, interior, cylindrical cavity and having a plurality of cavities on an exterior surface thereof for creating the pulsed pressure hydraulic fluid, and rotating means coupled to the rotor means for rotating the rotor means. In a preferred embodiment, the actuator means comprises a housing, a cylindrical cavity located within the housing, a piston located within the cylindrical cavity and being free to move along a lengthwise axis of the cylindrical cavity, and shaft means coupled to at least one side of the piston and extending from the housing for performing the work. In an alternative embodiment, at least one output from the pressurizing means is directly connected to the actuator means. The second and the third chamber means of the pulse generating means alternate both in providing the pulsed pressure hydraulic fluid to the actuator means and in returning the hydraulic fluid from the actuator means to the hydraulic fluid storage means.

Several different types of accumulators may be implemented. One embodiment of the accumulator means comprises a housing, a cylindrical cavity located within the housing and having a connection at an end of the cavity to a source of hydraulic fluid, a piston free to move along a lengthwise axis of the cylindrical cavity, and first spring means disposed between the end of the cylindrical cavity and a first end of the piston and second spring means disposed between a second end of the cylindrical cavity and a second end of the piston for permitting temporary storage of pressurized hydraulic fluid from the system and for returning the pressurized hydraulic fluid to the system. The second spring means comprises at least one of a spring and a bellville spring, or a combination of both.

Alternatively, the accumulator means comprises a housing, a cylindrical cavity located within the housing and having a connection at an end of the cavity to a source of hydraulic fluid, a piston free to move along a lengthwise axis of the cylindrical cavity, and a plurality of spring means disposed between another end of the cylindrical cavity and an end of the piston for permitting temporary storage of pressurized hydraulic fluid from the system and for returning the pressurized hydraulic fluid to the system.

The accumulator means may also comprise a housing, a cylindrical cavity located within the housing and having a connection at an end of the cylindrical cavity to a source of hydraulic fluid, a piston free to move along a lengthwise axis of the cylindrical cavity, first spring means disposed between the end of the cylindrical cavity and a first end of the piston and a gas disposed within a cavity formed by the cylindrical cavity and a second end of the piston for permitting temporary storage of pressurized hydraulic fluid from the system and for returning the pressurized hydraulic fluid to the system, and over pressure relief means coupled to the cavity to prevent over pressurization of the cavity.

The accumulator means may also define pulse intensifier means comprising a housing, a cylindrical cavity located within the housing and having a first connection at an end of the cavity to a source of hydraulic fluid and having a second connection at an opposite end of the cavity to another source of hydraulic fluid, a piston free to move along a lengthwise axis of the cylindrical cavity, a shaft having a smaller cross-sectional area than a cross-sectional area of the piston and the shaft being coupled to the piston and extending through the second connection at the opposite end of the cylindrical cavity, and first spring means disposed between the end of the cylindrical cavity and a first end of the piston and second spring means disposed between the opposite end of the cylindrical cavity and a second end of the piston for increasing pressure of the other source of hydraulic fluid relative to pressure of the source of hydraulic fluid.

Additionally, the aforementioned actuator means may comprise a hydraulic motor or one or more spray nozzles. Moreover, the pressurizing means comprises one or more hydraulic pumps. Additionally, one or more of the accumulator means may be coupled between the pressurizing means and the pulse generating means.

In accordance with another embodiment of this invention, a method of operating a pulse hydraulic system is provided comprising the steps of providing hydraulic fluid storage means for supplying the system with hydraulic fluid, providing pressurizing means coupled to the hydraulic fluid storage means for increasing pressure of the hydraulic fluid exiting from the hydraulic fluid storage means into the pressurizing means, providing pulse generating means coupled to the pressurizing means for creating pulsed pressure of hydraulic fluid output therefrom, providing actuator means coupled to at least one line of the pulse generating means and supplied with the hydraulic fluid from the pulse generating means for doing work, and providing accumulator means coupled between at least one of the pressurizing means and the pulse generating means, between the pulse generating means and the actuator means, and between the pulse generating means and the hydraulic fluid storage means for storing and supplying pressurized hydraulic fluid to the system. The step of providing the pulse generating means comprises the steps of providing cylindrical member means having a hollow, interior, cylindrical cavity and having a plurality of separate, grooved, exterior surface portions having a plurality of apertures there through for providing at least one chamber means for receiving hydraulic fluid from the pressurizing means, second chamber means for supplying the pulsed pressure hydraulic fluid to the actuator means, and third chamber means for returning the hydraulic fluid from the actuator means to the hydraulic fluid storage means via the pulse generating means, providing rotor means inserted within the hollow, interior, cylindrical cavity and having a plurality of cavities on an exterior surface thereof for creating the pulsed pressure hydraulic fluid, and providing rotating means coupled to the rotor means for rotating the rotor means. In a preferred embodiment, the step of providing the actuator means comprises the steps of providing a housing, providing one or more cylindrical cavities located within the housing, providing a piston located within the cylindrical cavity and being free to move along a lengthwise axis of the cylindrical cavity, and providing shaft means coupled to at least one side of the piston and extending from the housing for performing the work. In an alternative embodiment, at least one output from the pressurizing means is directly connected to the actuator means. The second and the third chamber means of the pulse generating means alternate both in providing the pulsed pressure hydraulic fluid to the actuator means and in returning the hydraulic fluid from the actuator means to the hydraulic fluid storage means.

There are several methods for operating the accumulators. Accordingly, one method for providing one or more accumulator means comprises the steps of providing a housing, providing a cylindrical cavity located within the housing and having a connection at an end of the cavity to a source of hydraulic fluid, providing a piston free to move along a lengthwise axis of the cylindrical cavity, and providing first spring means disposed between the end of the cylindrical cavity and a first end of the piston and second spring means disposed between a second end of the cylindrical cavity and a second end of the piston for permitting temporary storage of pressurized hydraulic fluid from the system and for returning the pressurized hydraulic fluid to the system. The second spring means comprises at least one of a spring and a bellville spring.

Another method for providing the accumulator means comprises the steps of providing a housing, providing a cylindrical cavity located within the housing and having a connection at an end of the cavity to a source of hydraulic fluid, providing a piston free to move along a lengthwise axis of the cylindrical cavity, and providing a plurality of spring means disposed between another end of the cylindrical cavity and an end of the piston for permitting temporary storage of pressurized hydraulic fluid from the system and for returning the pressurized hydraulic fluid to the system.

Another method for providing the accumulator means comprises the steps of providing a housing, providing a cylindrical cavity located within the housing and having a connection at an end of the cylindrical cavity to a source of hydraulic fluid, providing a piston free to move along a lengthwise axis of the cylindrical cavity, providing first spring means disposed between the end of the cylindrical cavity and a first end of the piston and a gas disposed within a cavity formed by the cylindrical cavity and a second end of the piston for permitting temporary storage of pressurized hydraulic fluid from the system and for returning the pressurized hydraulic fluid to the system, and providing over pressure relief means coupled to the cavity to prevent over pressurization of the cavity.

Another method for providing the accumulator means, or more accurately, pulse intensifier means, comprises the steps of providing a housing, providing a cylindrical cavity located within the housing and having a first connection at an end of the cavity to a source of hydraulic fluid and having a second connection at an opposite end of the cavity to another source of hydraulic fluid, providing a piston free to move along a lengthwise axis of the cylindrical cavity, providing a shaft having a smaller cross-sectional area than a cross-sectional area of the piston and the shaft being coupled to the piston and extending through the second connection at the opposite end of the cylindrical cavity, and providing first spring means disposed between the end of the cylindrical cavity and a first end of the piston and second spring means disposed between the opposite end of the cylindrical cavity and a second end of the piston for increasing pressure of the other source of hydraulic fluid relative to pressure of the source of hydraulic fluid.

Additionally, the step of providing the actuator means may comprise the step of coupling a hydraulic motor or one or more spray nozzles with the pulse generating means. The step of providing the pressurizing means comprises the step of providing one or more hydraulic pumps. Moreover, one or more of the accumulator means may be coupled between the pressurizing means and the pulse generating means, or directly into the pulse generating means input pressure chamber.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 6 is a perspective view with parts broken away from one embodiment of the pulse generator.

FIG. 7 is a cross-sectional view of the pulse generator from FIG. 6 showing the rotor inserted.

FIG. 8 is a cross-sectional view taken along the line 8—8 of FIG. 7.

FIG. 9 is a cross-sectional view taken along the line 9—9 of FIG. 7.

FIG. 10A is a simplified schematic diagram of another embodiment of an accumulator that may be used with the pulse hydraulic systems shown in FIGS. 1–4.

FIG. 10B is a simplified schematic diagram of another embodiment of a plurality of accumulators coupled together for use with any of the pulse hydraulic systems shown in FIGS. 1–4.

DESCRIPTION OF THE PREFERRED EMBODIMENTS

Figure 1:
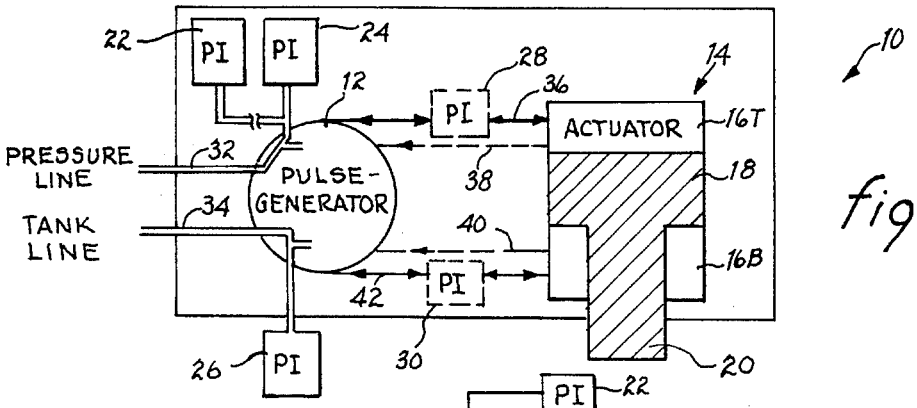
FIG. 1 is a simplified system diagram of one embodiment of the pulse hydraulic system including one or more accumulators.

Referring to FIG. 1, a simplified system diagram of one embodiment of the pulse hydraulic system is shown and generally designated by reference number 10. The system 10 includes a hydraulic fluid storage source or sump 11 (see FIG. 2) for supplying the system 10 with hydraulic fluid, such as hydraulic oil. A pressurizing source such as one or more hydraulic pumps 13 (see FIG. 2) is coupled to the hydraulic sump 11 via line 44 for increasing the pressure of hydraulic fluid exiting from the sump 11 into the pump(s) 13. The sump 11 and the pump(s) 13 are coupled to a pulse generator 12 via lines 32 and 34, respectively. Hydraulic sumps 11 and pumps 13 are well known in the art. Further, pulse generators such as pulse generator 12 are also well known in the art, and, in particular, the basic operation of a pulse generator is disclosed in U.S. Pat. No. 4,556,174. The pulse generator 12 is coupled to the hydraulic pump(s) 13 for creating pulses in the pressure of hydraulic fluid output from the pulse generator 12. As is described in full detail in U.S. Pat. No. 4,556,174, and as will be briefly discussed later, the pulse generator 12 has a plurality of separate chambers. One of these chambers is provided for receiving pressurized hydraulic fluid from the hydraulic pump 13. Please note that when the term hydraulic pump 13 is used, this may be interpreted to mean one or more hydraulic pumps or other hydraulic fluid pressurizing sources. Two additional chambers are provided for supplying pulsed pressurized hydraulic fluid from the pulse generator 12 to an actuator 14, and two chambers for returning hydraulic fluid from the actuator 14 to the sump 11 via the pulse generator 12. The chambers alternate the supply path and the return path. The pulse generator 12 of FIG. 1 would have at least six different chambers, namely, one corresponding to the pressurized hydraulic fluid discharged from the pump 13, another corresponding to line 36 for supplying pulsed, pressurized hydraulic fluid to the top 16T of the actuator 14, another corresponding to line 38 for returning pressurized hydraulic fluid from the top 16T of the actuator 14 to the sump 11, another corresponding to line 42 for supplying pulsed, pressurized hydraulic fluid to the bottom 16B of the actuator 14, another corresponding to line 40 for returning pressurized hydraulic fluid from the bottom 16B of the actuator 14 to the sump 11, and another for returning hydraulic fluid from the pulse generator 12 to the sump 11. When pulsed, pressurized hydraulic fluid is supplied via line 36 to the top 16T of the actuator 14, hydraulic fluid from the bottom 16B of the actuator 14 returns to the sump 11 via lines 34 and 40 and the pulse generator 12. Similarly, when pulsed, pressurized hydraulic fluid is supplied via line 42 to the bottom 16B of the actuator 14, hydraulic fluid from the top 16T of the actuator 14 returns to the sump 11 via line 34 and 38 and the pulse generator 12. As the pulse generator 12 operates, the supply path for the pulsed, pressurized hydraulic fluid and the return path are alternated from the top 16T to the bottom 16B of the actuator 14, thereby causing the piston 18 and the shaft 20 of the actuator 14 to oscillate back and forth..

Again referring to FIG. 1, the implementation of accumulators 22–26 and pulse intensifiers 28–30 significantly increases the efficiency of operation of the system 10. The manner in which the accumulators 22–26 and the pulse intensifiers 28–30 accomplish this improvement will be discussed hereinafter. Recall that as the rotor of the pulse generator 12 rotates, the supply and return flow paths are established and, temporarily blocked by closed portions of the rotor. Consequently, when the rotor temporarily closes off the flow paths, the energy associated with the discharge pressure of the pump 13 is not used for doing work. The accumulators 22–24 provide a manner for storing the pressurized hydraulic fluid from the pump 13 discharge when the flow paths from the pulse generator 12 to the actuator 14 are temporarily closed, and then returning this stored, pressurized hydraulic fluid from accumulators 22–24 to the pump 13 discharge header when the flow paths from the pulse generator 12 to the actuator 14 are re-established. One or more accumulators may be used where accumulators 22 and 24 are shown. The reason for this will become more apparent when the structural configuration of the accumulators 22–26 is discussed with respect to FIGS. 5A–D, however, the basic rational is as follows. The rotational velocity of the rotor of the pulse generator 12 determines the frequency of the pulses in pressure of the hydraulic fluid. Different applications of the system 10 sometimes require different frequencies of the pulses. Different types of accumulators 22–26 and pulse intensifiers 28–30 respond differently to different frequencies. Consequently, in order to cover a broad range of operating frequencies of pulses, several accumulators 22 and 24, or more, may be connected in parallel or in series between the discharge of the pump 13 and the pressure input chamber of the pulse generator 12. Typically, only one accumulator 26 would be used between the pulse generator 12 and the sump 11, however, more than one could be used here as well. Any of the accumulators shown on FIGS. 5A–D, or equivalents thereof, could be used for accumulators 22–26, while pulse intensifiers 28 and 30 would use the pulse intensifier shown in FIG. 5E, or equivalents thereof. Whereas the accumulators 22–24 are used to store hydraulic fluid from and subsequently return hydraulic fluid to between the discharge of the pump 13 and the input chamber of the pulse generator 12, and whereas accumulator 26 is used to store hydraulic fluid from and subsequently return hydraulic fluid to between the pulse generator 12 and the sump 11, pulse intensifiers 28 and 30 are used to increase the pressure of the pulsed pressure hydraulic fluid leaving the pulse generator 12 and entering either the top 16T or the bottom 16B, respectively, of the actuator 14. It should be pointed out that any one of the accumulators 22–26 and the pulse intensifiers 28–30 may be used by itself. In addition, all of the accumulators 22–26 and the pulse intensifiers 28–30 could be used together, as shown in FIG. 1. Moreover, one could use any subset combination of all of the accumulators 22–26 and the pulse intensifiers 28–30 shown in FIG. 1. For example, more than two accumulators could be used where accumulators 22 and 24 are located in FIG. 1, in combination with pulse intensifiers 28 and 30 where they are located in FIG. 1 (i.e. leaving out accumulator 26).

Again referring to FIG. 1, the actuator 14 is coupled to the pulse generator 12 for doing some kind of work. In particular, the actuator comprises a housing, a cylindrical cavity 16T and 16B located within the housing, a piston 18 located within the cylindrical cavity 16T and 16B and free to move along the lengthwise axis of the cylindrical cavity 16T and 16B, and a shaft 20 coupled to at least one side of the piston 18 for performing work. The shaft 20 oscillates for performing some task. It should be pointed out that U.S. Pat. No. 4,556,174 demonstrates some of the tasks that a pulse hydraulic system can perform. It should also be pointed out that those with skills well known in the pulse hydraulics art could connect a hydraulic motor or one or more spray nozzles to the pulse generator 12 in lieu of the actuator 14.

Figure 2:
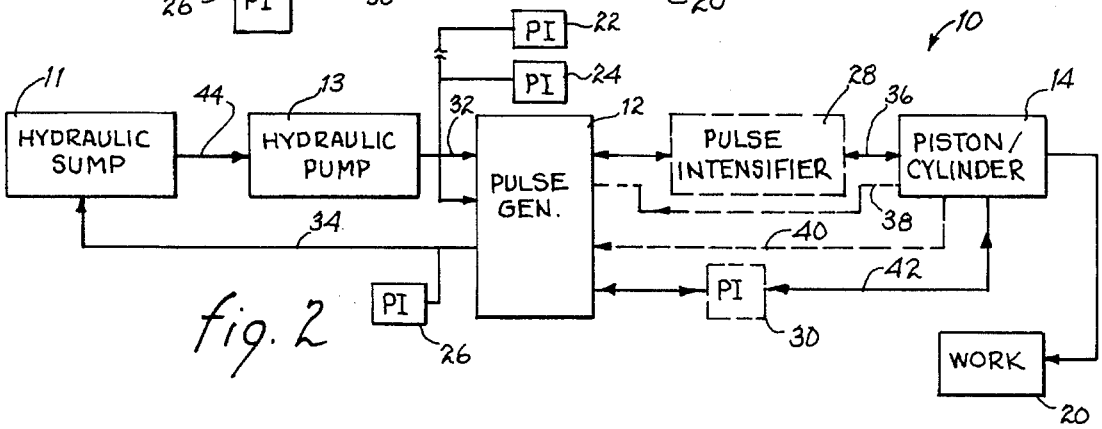
FIG. 2 is a simplified functional block diagram corresponding to the system shown in FIG. 1.

Referring to FIG. 2, a simplified functional block diagram corresponding to the system 10 from FIG. 1 is shown. One or more hydraulic pumps 13 draw hydraulic fluid from the hydraulic sump 11 and discharge pressurized hydraulic fluid to the pulse generator 12. The accumulators 22 and 24 are also coupled to the discharge header of the hydraulic pump 13. The pulse generator 12 creates a series of pulses in the pressure of the hydraulic fluid exiting therefrom. This pulsed hydraulic fluid passes through pulse intensifier 28 which increases the pressure of the pulsed pressure hydraulic fluid exiting the pulse generator 12. The pulsed pressure hydraulic fluid leaving pulse intensifier 28 enters the cavity 16T of the actuator 14. In FIG. 2, the actuator 14 is simply referred to as the piston/cylinder. The force associated with the pulsed pressure hydraulic fluid in the cavity 16T causes the work 20 to be performed. The hydraulic fluid in cavity 16B is forced through the return line 40, through the pulse generator 12, and through line 34 back to the sump 11. Note that the pulse intensifier 26 is coupled to the return header between the pulse generator 12 and the sump 11. In a similar manner, as the pulse generator 12 operates, the pulsed hydraulic fluid is supplied via the pulse intensifier 30 to the bottom cavity 16B of the actuator 14, and the return hydraulic fluid travels through line 38 back to the sump 11 via the pulse generator 12 and line 34. The flow paths alternate as the pulse generator 12 operates.

Figure 3:
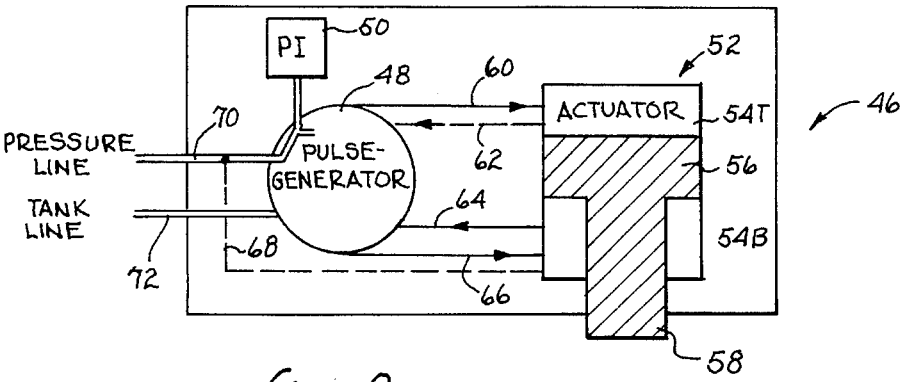
FIG. 3 is a simplified system diagram of another embodiment of the pulse hydraulic system including one or more accumulators (only one is shown) and a direct connection from the pressure line to the actuator.
Figure 4:
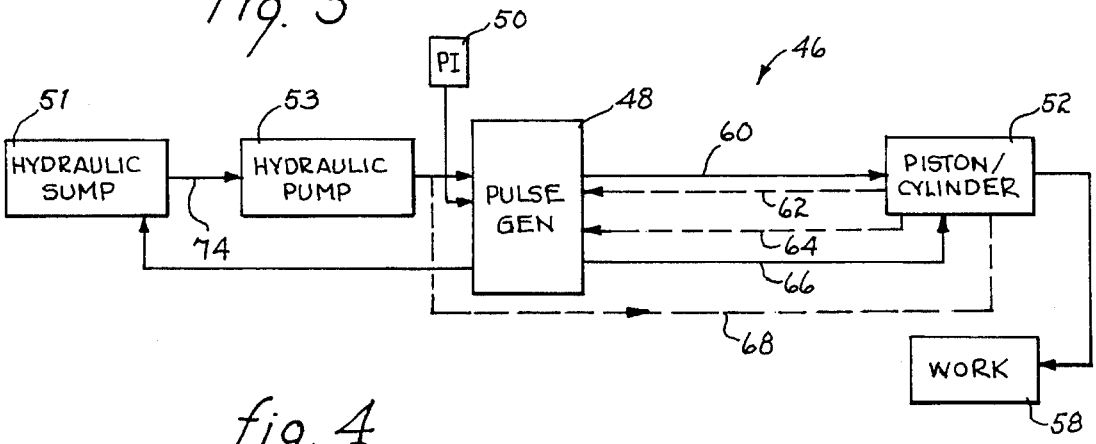
FIG. 4 is a simplified functional block diagram corresponding to the system shown in FIG. 2.

Referring to FIGS. 3 and 4, a simplified system diagram, and a corresponding functional block diagram, of another embodiment of the pulse hydraulic system is shown and generally designated by reference number 46. The system 46 includes a hydraulic fluid storage source or sump 51 (see FIG. 4) for supplying the system 46 with hydraulic fluid, such as hydraulic oil. A pressurizing source such as one or more hydraulic pumps 53 (see FIG. 4) is coupled to the hydraulic sump 51 via line 74 for increasing the pressure of hydraulic fluid exiting from the sump 51 into the pump 53. The sump 51 and the pump 53 are coupled to a pulse generator 48 via lines 72 and 70, respectively. Pulse generators such as pulse generator 48 are well known in the art, and, in particular, the basic operation of a pulse generator is disclosed in U.S. Pat. No. 4,556,174. The pulse generator 48 is coupled to the hydraulic pump 53 for creating pulses in the pressure of hydraulic fluid output from the pulse generator 48. Please note that when the term hydraulic pump 53 is used, this may be interpreted to mean one or more hydraulic pumps or other hydraulic fluid pressurizing sources. The pulse generator 48 is coupled to the top cavity 54T and the bottom cavity 54B of the actuator 52 via supply line 60 and return line 62 and via supply line 66 and return line 64, respectively. The actuator 52 has a piston 56 with a shaft 58 coupled thereto for doing work. The basic operation of the pulse hydraulic system 46 shown in FIGS. 3 and 4 is similar to the operation of the pulse hydraulic system 10 shown in FIGS. 1 and 2. The pulse hydraulic system 46 is shown with only one accumulator 50 coupled between the discharge header of the pump 53 and the pressure inlet for the pulse generator 48, however, note that a plurality of accumulators could be used in this system 46 as was discussed with respect to the system 10 shown in FIGS. 1 and 2. The pulse hydraulic system 46 is shown with a line 68 coupling the discharge header of the pump 53 directly to the bottom cavity 54B of the actuator 52. Another line similar to line 68 could be used to couple the discharge header of the pump 53 directly to the top cavity 54T of the actuator 52. The use of these lines permits a user to apply non-pulsed pressure hydraulic fluid to the actuator 52. It should be pointed out that these direct lines 68 (only one is shown) from the discharge header of the pump 53 directly to the actuator 52 could be implemented with a control valve to control the flow there through.

Figure 5A:
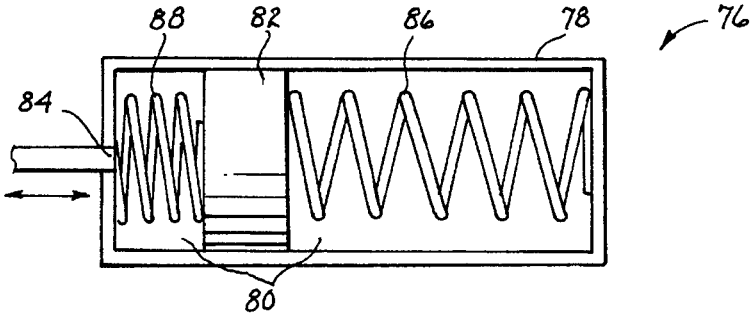
FIG. 5A is a cross-sectional view of one embodiment of an accumulator.

Referring to FIG. 5A, an embodiment of the accumulator is shown and generally designated by reference number 76. The accumulator 76 has a housing 78, a cylindrical cavity 80 located within the housing 78 and having a connection at an end 84 of the cavity 80 to a source of hydraulic fluid. A piston 82 is free to move along a lengthwise axis of the cylindrical cavity 80. A first spring 88 is disposed between the end 84 of the cylindrical cavity 80 and a first end of the piston 82 and a second spring 86 is disposed between a second end of the cylindrical cavity 80 and a second end of the piston 82. This embodiment of the accumulator 76 could be used in the pulse hydraulic system 10 for accumulators 22–26, and the accumulator 76 could be used in the pulse hydraulic system 46 for accumulator 50. As previously disclosed, temporary flow path blockage occurs due to the operation of the pulse generator 12 or 48. Thus, during such temporary flow path blockage, the accumulator 76 permits temporary storage of pressurized hydraulic fluid from the system 10 or 46, and then when the flow paths are re-established, the force due to the spring 86 returns the pressurized hydraulic fluid to the system 10 or 46. The spring 88 is used to aid the pressure of the hydraulic fluid in forcing the piston 82 against the spring 86. The selection of the size and strength of the springs 86 and 88 is a function of the pressure of the hydraulic fluid.

Figure 5B:
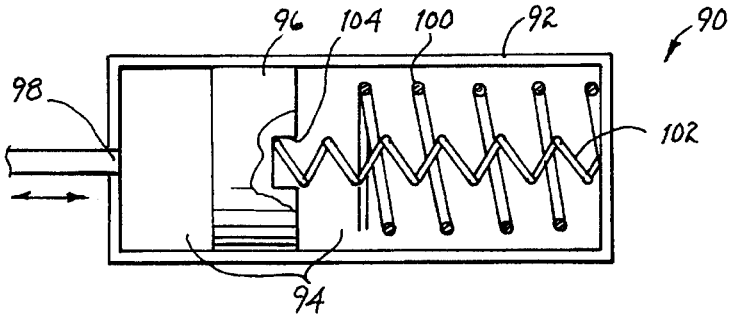
FIG. 5B is a cross-sectional view of another embodiment of an accumulator.

Referring to FIG. 5B, another embodiment of the accumulator is shown and generally designated by reference number 90. The accumulator 90 has a housing 92 and a cylindrical cavity 94 located within the housing 92. The cylindrical cavity 94 has a connection at an end 98 thereof to a source of hydraulic fluid. A piston 96 is free to move along a lengthwise axis of the cylindrical cavity 94. A plurality of springs 100 and 102 are disposed between another end of the cylindrical cavity 94 and an end of the piston 96. Note that the piston 96 has a notch for receiving an end of spring 102. This embodiment of the pulse intensifier 90 could be used in the pulse hydraulic system 10 for accumulators 22–26, and the accumulator 90 could be used in the pulse hydraulic system 46 for accumulator 50. During temporary flow path blockage, the accumulator 90 permits temporary storage of pressurized hydraulic fluid from the system 10 or 46, and then when the flow paths are re-established, the force due to the spring 102 or the force due to both springs 100 and 102 returns the pressurized hydraulic fluid to the system 10 or 46. In other words, under lower hydraulic fluid pressure, perhaps only spring 102 is used, whereas at a higher hydraulic fluid pressure, both springs 100 and 102 would be used to return the hydraulic fluid to the system 10 or 46. The selection of the size and strength of the springs 100 and 102 is a function of the pressure of the hydraulic fluid.

Figure 5C:
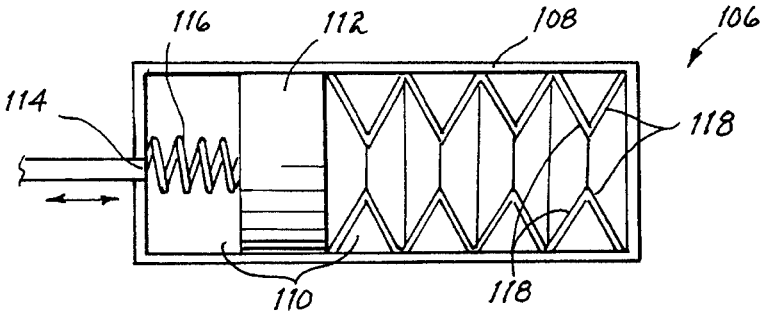
FIG. 5C is a cross-sectional view of yet another embodiment of an accumulator.

Referring to FIG. 5C, another embodiment of the accumulator is shown and generally designated by reference number 106. The accumulator 106 has a housing 108 and a cylindrical cavity 110 located within the housing 108. The cylindrical cavity 110 has a connection at an end 114 thereof to a source of hydraulic fluid. A piston 112 is free to move along a lengthwise axis of the cylindrical cavity 110. A first spring 116 is disposed between the end 114 of the cylindrical cavity 110 and a first end of the piston 112. A second spring 118 is disposed between a second end of the cylindrical cavity 110 and a second end of the piston 112. The second spring 118 comprises a bellville type spring which is well known in the art. Basically, a bellville spring is a plurality of curved discs having a hole in the center of each disc. The plurality of curved discs are placed edge to edge in an alternating manner between concave and convex curved discs. This embodiment of the accumulator 106 could be used in the pulse hydraulic system 10 for accumulators 22–26, and the accumulator 106 could be used in the pulse hydraulic system 46 for accumulator 50. During temporary flow path blockage, the accumulator 106 permits temporary storage of pressurized hydraulic fluid from the system 10 or 46, and then when the flow paths are re-established, the force due to the spring 118 returns the pressurized hydraulic fluid to the system 10 or 46. The spring 116 is used to aid the pressure of the hydraulic fluid in forcing the piston 112 against the spring 118. The selection of the size and strength of the springs 116 and 118 is a function of the pressure of the hydraulic fluid.

Figure 5D:
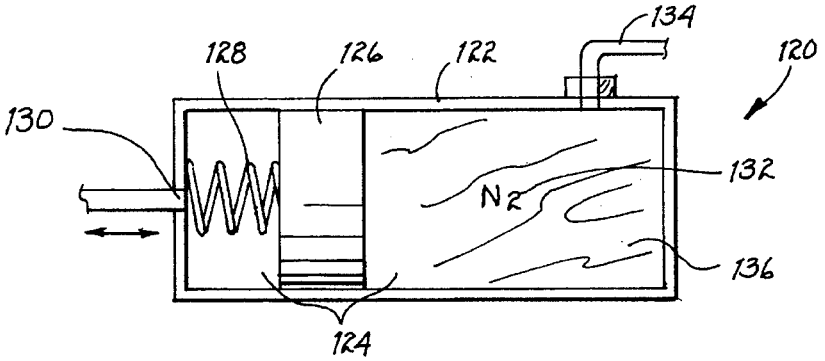
FIG. 5D is a cross-sectional view of a further embodiment of an accumulator.

Referring to FIG. 5D, yet another embodiment of the accumulator is shown and generally designated by reference number 120. The accumulator 120 has a housing 122 and a cylindrical cavity 124 located within the housing 122. The cylindrical cavity 124 has a connection at an end 130 thereof to a source of hydraulic fluid. A piston 126 is free to move along a lengthwise axis of the cylindrical cavity 124. A first spring 128 is disposed between the end 130 of the cylindrical cavity 124 and a first end of the piston 126. A gas 132 such as Nitrogen is disposed within a cavity 136 formed by the cylindrical cavity 124 and a second end of the piston 126. An over pressure relief valve (not shown) is connected at 134 to the cavity 136 in order to prevent over pressurization of the cavity 136. Over pressure relief valves are well known in the art. The connection 134 can also be used to charge the cavity 136 with the gas 132. This embodiment of the accumulator 120 could be used in the pulse hydraulic system 10 for accumulators 22–26, and the accumulator 120 could be used in the pulse hydraulic system 46 for accumulator 50. During temporary flow path blockage, the accumulator 120 permits temporary storage of pressurized hydraulic fluid from the system 10 or 46, and then when the flow paths are re-established, the force due to the compressed gas 132 returns the pressurized hydraulic fluid to the system 10 or 46. The spring 128 is used to aid the pressure of the hydraulic fluid in forcing the piston 126 against the force associated with the gas 132 being compressed. The selection of the size and strength of the spring 128, and the selection of gas type and initial pressure of the gas 132 is a function of the pressure of the hydraulic fluid.

Figure 5E:
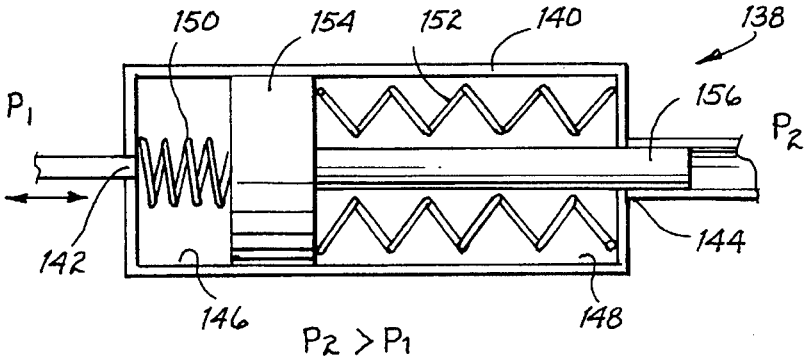
FIG. 5E is a cross-sectional view of an embodiment of a pulse intensifier.

Referring to FIG. 5E, an embodiment of a pulse intensifier is shown and generally designated by reference number 138. The pulse intensifier 138 has a housing 140 and a cylindrical cavity 146 and 148 located within the housing 140. A first connection is made at an end 142 of the cavity 146 and 148 to a source of hydraulic fluid, and a second connection is made at an opposite end 144 of the cavity 146 and 148 to another source of hydraulic fluid. A piston 154 is free to move along a lengthwise axis of the cylindrical cavity 146 and 148. A shaft 156, having a smaller cross-sectional area than the cross-sectional area of the piston 154, is coupled to the piston 154 and extends through the second connection at the opposite end 144 of the cylindrical cavity 146 and 148. A first spring 150 is disposed between the end 142 of the cylindrical cavity 146 and 148 and a first end of the piston 154, and a second spring 152 is disposed between the opposite end 144 of the cylindrical cavity 146 and 148 and a second end of the piston 154. This embodiment of the pulse intensifier 138 could be used in the pulse hydraulic system 10 for pulse intensifiers 28–30, or in lines 34 and 32. The use of the pulse intensifier 138 in either of the pulse hydraulic systems 10 or 46 would be analogous to the use of an amplifier in an electrical circuit, because the pulse intensifier 138 takes the supply pressure P1 from the pulse generator 12 or 48 and causes the pressure P2 entering the actuator 14 or 52 to exceed P1. The pulse intensifier 138 provides this pressure amplification due to the cross-sectional area of the shaft 156, which acts upon the hydraulic fluid entering the actuator 14 or 52, being less than the cross-sectional area of the piston 154, which is acted upon by the hydraulic fluid from the pulse generator 12 or 48. The selection of the size and strength of the springs 150 and 152 will also affect the amplification characteristics of the pulse intensifier 138.

It should again be pointed out that the accumulators 76, 90, 106, and 120 are designed for connection either between the pump discharge 13 or 53 and the pressure inlet of the pulse generator 12 or 48 or between the return path from the pulse generator 12 or 48 and the sump 11 or 51. In contrast, the pulse intensifier 138 is intended to be connected between one of the pulsed pressure outputs of the pulse generator 12 or 48 and the actuator 14 or 52. There are numerous other possible arrangements to permit an expansion volume for pressurized hydraulic fluid. Thus, other types of accumulators similar in function and operation to pulse intensifiers 76, 90, 106, and 120 may be implemented with the pulse hydraulic systems 10 and 46. The key point is that they must permit the expansion of a volume of pressurized hydraulic fluid from a pulse hydraulic system and then return the pressurized hydraulic fluid to the system. Alternatively, there are numerous other possible arrangements to permit pressure amplification of a hydraulic fluid such as is done with the pulse intensifier 138. Thus, other types of pulse intensifiers similar in function and operation to the pulse intensifier 138 may be implemented with the pulse hydraulic systems 10 and 46.

With this point in mind, FIGS. 10A and 10B show an alternative embodiment that may be used with accumulators 76, 90, 106, and 120. Thus far, the accumulators 76, 90, 106, and 120 have been shown having only a single connection to a source of hydraulic fluid. In this case, despite the fact that during the operation of the system 10 or 46, hydraulic fluid would move in and out of the volume of any of the accumulators 76, 90, 106, and 120, it would be possible to have a portion of this hydraulic fluid remain within any of the accumulators 76, 90, 106, and 120 for an extended period of time. This could result in unwanted heating of the hydraulic fluid. Additionally, with only a single flow path into each of the accumulators 76, 90, 106, and 120, it is possible that a portion of air could be caught between the inlet to any one of the accumulators 76, 90, 106, and 120 and the piston surface therein. This is an undesirable condition. Consequently, any of the accumulators 76, 90, 106, and 120 can have more than one input/output as shown in FIGS. 10A and 10B.

Referring to FIG. 10A, a single accumulator having any of the embodiments 76, 90, 106, and 120 could be connected between either the discharge header of the pump 13 or 53 and the pressure inlet to the pulse generator 12 or 48, or between the return header of the pulse generator 12 or 48 and the sump 11 or 51. In the first case, the inlet to the accumulator 76, 90, 106, or 120 would be connected to the discharge header of the pump 13 or 53 and the outlet of the pulse intensifier 76, 90, 106, or 120 would be connected to the pressure inlet to the pulse generator 12 or 48. In the second case, the inlet to the accumulator 76, 90, 106, or 120 would be connected to the return header of the pulse generator 12 or 48 and the outlet of the accumulator 76, 90, 106, or 120 would be connected to the sump 11 or 51.

In a similar manner, a plurality of accumulators 76, 90, 106, or 120 could be connected in a chain arrangement as shown in FIG. 10B. The inlet of the first accumulator 76, 90, 106, or 120 in the chain would be connected to either the discharge header of the pump 13 or 53 or to the return header of the pulse generator 12 or 48. The outlet of the last accumulator 76, 90, 106, or 120 in the chain would be connected to either the pressure side of the pulse generator 12 or 48 or the sump 11 or 51. The only difference is that the outlet of each accumulator 76, 90, 106, or 120, except for the last one, is connected to the inlet of an adjacent accumulator 76, 90, 106, or 120. With the arrangement shown for accumulators 76, 90, 106, or 120 in FIGS. 10A and 10B, the aforementioned potential heating and air accumulation problems would be avoided.

Referring to FIGS. 6–9, several views of a simplified pulse generator 12 or 48 are shown. It should be pointed out that a full description of the operation of the pulse generator 12 or 48 is not necessary because such information is well known to those skilled in the art, and, furthermore, it is available is U.S. Pat. No. 4,556,174. The pulse generator 12 or 48 comprises a cylindrical member 158 having a hollow, interior, cylindrical cavity. The cylindrical member 158 has a plurality of separate, grooved, exterior surface portions 162–166 having a plurality of apertures 168. The chamber 162 receives hydraulic fluid from the discharge of the pump 13 or 53. The second 164 and third 166 chambers are connected to the actuator 14 or 52 for alternatively supplying the pulsed pressure hydraulic fluid to the actuator 14 or 52, and for returning the hydraulic fluid from the actuator 14 or 52 to the sump 11 or 51 via the pulse generator 12 or 48. A rotor 160 is inserted within the hollow, interior, cylindrical cavity of the cylindrical member 158. The rotor 160 has a plurality of cavities 171 and 172 on an exterior surface thereof for creating the pulsed pressure hydraulic fluid. The groove 170 of the rotor 160 aligns with the chamber 162 where pressurized hydraulic fluid is provided from the pump 13 or 53. The pressurized hydraulic fluid travels to the cavities 171 where the pressurized hydraulic fluid exits through the apertures 168 in either chamber 164 or 166 depending upon the relative position between the rotor 160 and the apertures 168. A source for rotating the rotor 160 such as an electric motor (not shown) is provided. Assuming that the pressurized hydraulic fluid travels to the cavities 171 corresponding to chamber 164, pulsed pressure hydraulic fluid will be supplied to the actuator 14 or 52 from chamber 164. Thus, chamber 166 forms the return path, and the cavities 172 corresponding to chamber 166 release hydraulic fluid to return passage 176 and the hydraulic fluid exits the cylindrical member 158 through aperture 174. As the rotor 160 rotates, the chambers 164 and 166 alternate in providing the supply and return paths to the actuator 14 or 52 via ports 178 and 180, and the continuous series of interruption in providing flow paths to the actuator 14 or 52 is what provides the pulses in the pressure of the hydraulic fluid. Note that FIG. 8 shows a pressure supply line 182 from the pump 13 or 53 to the pulse generator 12 or 48. It should be pointed out that the pulse generator 12 or 48 used in FIGS. 1–4 actually has six chambers as opposed to three chambers 162–166, but this simplified explanation of the operation of the three chamber pulse generator shown in FIGS. 6–9 is largely analogous to the operation of the six chamber pulse generator 12 or 48 used in the pulse hydraulic systems 10 and 46.

OPERATION

Referring to FIG. 1, one or more hydraulic pumps 13 draw hydraulic fluid from the hydraulic sump 11 and discharge pressurized hydraulic fluid to the pulse generator 12. The accumulators 22 and 24 are also coupled to the discharge header of the hydraulic pump 13. The pulse generator 12 creates a series of pulses in the pressure of the hydraulic fluid exiting therefrom. This pulsed hydraulic fluid passes through pulse intensifier 28 which increases the pressure of the pulsed pressure hydraulic fluid exiting the pulse generator 12. The pulsed pressure hydraulic fluid leaving pulse intensifier 28 enters the cavity 16T of the actuator 14. The force associated with the pulsed pressure hydraulic fluid in the cavity 16T causes the work 20 to be performed. The hydraulic fluid in cavity 16B is forced through the return line 40, through the pulse generator 12, and through line 34 back to the sump 11. Note that the accumulator 26 is coupled to the return header between the pulse generator 12 and the sump 11. In a similar manner, as the pulse generator 12 operates, the pulsed hydraulic fluid is supplied via the pulse intensifier 30 to the bottom cavity 16B of the actuator 14, and the return hydraulic fluid travels through line 38 back to the sump 11 via the pulse generator 12 and line 34. The flow paths alternate as the pulse generator 12 operates.

Pulse generators such as pulse generator 12 are well known in the art, and, in particular, the basic operation of a pulse generator is disclosed in U.S. Pat. No. 4,556,174. The pulse generator 12 is coupled to the hydraulic pump 13 for creating pulses in the pressure of hydraulic fluid output from the pulse generator 12. As is described in full detail in U.S. Pat. No. 4,556,174, the pulse generator 12 has a plurality of separate chambers. One of these chambers is provided for receiving pressurized hydraulic fluid from the hydraulic pump 13. Please note that when the term hydraulic pump 13 is used, this may be interpreted to mean one or more hydraulic pumps or other hydraulic fluid pressurizing sources. Two additional chambers are provided for supplying pulsed pressurized hydraulic fluid from the pulse generator 12 to an actuator 14, and for returning hydraulic fluid from the actuator 14 to the sump 11 via the pulse generator 12. The two additional chambers alternate between providing the supply path and the return path. In practice, the pulse generator 12 or 48 of FIGS. 1–4 would have at least six different chambers, namely, one corresponding to the pressurized hydraulic fluid discharge from the pump 13, another corresponding to line 36 for supplying pulsed, pressurized hydraulic fluid to the top 16T of the actuator 14, another corresponding to line 38 for returning pressurized hydraulic fluid from the top 16T of the actuator 14, another corresponding to line 42 for supplying pulsed, pressurized hydraulic fluid to the bottom 16B of the actuator 14, another corresponding to line 40 for returning pressurized hydraulic fluid from the bottom 16B of the actuator 14, and another chamber for returning hydraulic fluid to the sump 11. When pulsed, pressurized hydraulic fluid is supplied via line 36 to the top 16T of the actuator 14, pressurized hydraulic fluid from the bottom 16B of the actuator 14 returns to the sump 11 via lines 34 and 40 and the pulse generator 12. Similarly, when pulsed, pressurized hydraulic fluid is supplied via line 42 to the bottom 16B of the actuator 14, pressurized hydraulic fluid from the top 16T of the actuator 14 returns to the sump 11 via lines 34 and 38 and the pulse generator 12. As the pulse generator 12 operates, the supply path for the pulsed, pressurized hydraulic fluid and the return path are alternated from the top 16T to the bottom 16B of the actuator 14, thereby causing the piston 18 and the shaft 20 of the actuator 14 to vibrate.

Again referring to FIG. 1, the actuator 14 is coupled to the pulse generator 12 for doing some kind of work. It should be pointed out that U.S. Pat. No. 4,556,174 demonstrates some of the tasks that a pulse hydraulic system can perform. It should also be pointed out that those with skills well known in the hydraulics art could connect a hydraulic motor or one or more spray nozzles to the pulse generator 12 in lieu of the actuator 14. Such a hydraulic motor would have a rotating shaft with oscillations of rotation, and furthermore, each spray nozzle would have a pulsed pressure spray.

Again, recall that as the rotor of the pulse generator 12 rotates, the supply and return flow paths are established and, temporarily blocked by closed portions of the rotor. Consequently, when the rotor temporarily closes off the flow paths, the energy associated with the discharge pressure of the pump 13 is not used for doing work. The accumulators 22–24 provide a manner for storing the pressurized hydraulic fluid from the pump 13 discharge when the flow paths from the pulse generator 12 to the actuator 14 are temporarily closed, and then returning this stored, pressurized hydraulic fluid to the pump 13 discharge header when the flow paths from the pulse generator 12 to the actuator 14 are re-established. One or more accumulators may be used where accumulators 22 and 24 are shown. The rotational velocity of the rotor of the pulse generator 12 determines the frequency of the pulses in pressure of the hydraulic fluid. Different applications of the system 10 sometimes require different frequency of the pulses. Different types of accumulators and pulse intensifiers 22–30 respond differently to different frequencies. Consequently, in order to cover a broad range of operating frequencies of pulses, several accumulators 22 and 24, or more, may be connected in parallel between the discharge of the pump 13 and the pressure input chamber of the pulse generator 12. Typically, only one accumulator 26 would be used between the pulse generator 12 and the sump 11, however, more than one could be used here as well. Any of the accumulators shown on FIGS. 5A–D, or equivalents thereof, could be used for accumulators 22–26, while pulse intensifiers 28 and 30 would use the pulse intensifier shown in FIG. 5E, or equivalents thereof. Whereas the accumulators 22–24 are used to store hydraulic fluid from and subsequently return hydraulic fluid to between the discharge of the pump 13 and the input chamber of the pulse generator 12, pulse intensifiers 28 and 30 are used to increase the pressure of the pulsed pressure hydraulic fluid leaving the pulse generator 12 and entering either the top 16T or the bottom 16B, respectively, of the actuator 14. Also, recall that any of accumulators 76, 90, 106, and 120 can have either of the configurations discussed with respect to FIGS. 10A and 10B.

The system 46 shown in FIGS. 3 and 4 operates largely the same as that discussed for FIGS. 1 and 2 with the exception of line 68 which permits a user to send non-pulsed pressure hydraulic fluid directly from the pump 53 to the actuator 52.

While the invention has been particularly shown and described with reference to the preferred embodiments thereof, it will be understood by those skilled in the art that the foregoing and other changes in form and details may be made therein without departing from the spirit and scope of the invention. For example, a housing containing the pulse generator 12, the actuator 14, one or more accumulators and/or pulse intensifiers 22–30, and the associated connecting lines for coupling therebetween and for coupling to an external pump and sump may have a vibration dampening material, such as rubber, on a portion thereof in order to limit vibrations external to the housing. Additionally, if desired, the actuator 14 may be provided with one or more springs for helping to bias the piston 18. Also, the pressure supply line 34 and the sump return line 32 could be combined into a single co-axial line with the pressure supply line 34 surrounded and isolated from the outer, co-axial sump return line 32.

What is claimed is:

1. A pulse hydraulic system comprising, in combination:

hydraulic fluid storage means for supplying said system with hydraulic fluid;

pressurizing means coupled to said hydraulic fluid storage means for increasing pressure of said hydraulic fluid exiting from said hydraulic fluid storage means into said pressurizing means;

pulse generating means coupled to said pressurizing means for creating pulsed pressure of hydraulic fluid output therefrom;

actuator means having a plurality of lines connected to a top portion thereof from said pulse generating means and having another plurality of lines connected to a bottom portion thereof from said pulse generating means for doing work; and accumulator means coupled between at least one of said pressurizing means and said pulse generating means, between said pulse generating means and said actuator means, and between said pulse generating means and said hydraulic fluid storage means for storing and supplying pressurized hydraulic fluid to said system;

accumulator means coupled between said pressurizing means and said pulse generating means being connected with a line from said pressurizing means within a portion of said pulse generating means.

2. The system of claim 1 wherein said pulse generating means comprises:

cylindrical member means having a hollow, interior, cylindrical cavity and having a plurality of separate, grooved, exterior surface portions having a plurality of apertures there through for providing at least one chamber means for receiving hydraulic fluid from said pressurizing means, second chamber means for supplying said pulsed pressure hydraulic fluid to said actuator means, and third chamber means for returning said hydraulic fluid from said actuator means to said hydraulic fluid storage means via said pulse generating means;

rotor means inserted within said hollow, interior, cylindrical cavity and having a plurality of cavities on an exterior surface thereof for creating said pulsed pressure hydraulic fluid; and rotating means coupled to said rotor means for rotating said rotor means.

3. The system of claim 2 wherein said actuator means comprises:

a housing;

a cylindrical cavity located within said housing;

a piston located within said cylindrical cavity and free to move along a lengthwise axis of said cylindrical cavity; and shaft means coupled to at least one side of said piston and extending from said housing for performing said work.

4. The system of claim 3 wherein at least one output from said pressurizing means is directly connected to said actuator means.

5. The system of claim 3 wherein said second and said third chamber means of said pulse generating means alternate both in providing said pulsed pressure hydraulic fluid to said actuator means and in returning said hydraulic fluid from said actuator means in separate lines to said hydraulic fluid storage means.

6. The system of claim 2 wherein said actuator means comprises a hydraulic motor.

7. The system of claim 2 wherein said actuator means comprises at least one spray nozzle.

8. The system of claim 1 wherein said accumulator means comprises:

a housing;

a cylindrical cavity located within said housing and having a connection at an end of said cavity to a source of hydraulic fluid;

a piston free to move along a lengthwise axis of said cylindrical cavity; and first spring means disposed between said end of said cylindrical cavity and a first end of said piston and second spring means disposed between a second end of said cylindrical cavity and a second end of said piston for permitting temporary storage of pressurized hydraulic fluid from said system and for returning said pressurized hydraulic fluid to said system.

9. The system of claim 8 wherein said second spring means comprises at least one of a spring and a bellville spring.

10. The system of claim 1 wherein said accumulator means comprises:

a housing;

a cylindrical cavity located within said housing and having a connection at an end of said cavity to a source of hydraulic fluid;

a piston free to move along a lengthwise axis of said cylindrical cavity; and a plurality of spring means disposed between another end of said cylindrical cavity and an end of said piston for permitting temporary storage of pressurized hydraulic fluid from said system and for returning said pressurized hydraulic fluid to said system.

11. The system of claim 1 wherein said accumulator means comprises:

a housing;

a cylindrical cavity located within said housing and having a connection at an end of said cylindrical cavity to a source of hydraulic fluid;

a piston free to move along a lengthwise axis of said cylindrical cavity;

first spring means disposed between said end of said cylindrical cavity and a first side of said piston and a gas disposed within a cavity formed by said cylindrical cavity and a second side of said piston for permitting temporary storage of pressurized hydraulic fluid from said system and for returning said pressurized hydraulic fluid to said system; and over pressure relief means coupled to said cavity to prevent over pressurization of said cavity.

12. The system of claim 1 wherein another of said accumulator means comprises:

a housing;

a cylindrical cavity located within said housing and having a first connection at an end of said cavity to a source of hydraulic fluid and having a second connection at an opposite end of said cavity to another source of hydraulic fluid;

a piston free to move along a lengthwise axis of said cylindrical cavity;

a shaft having a smaller cross-sectional area than a cross-sectional area of said piston and said shaft being coupled to said piston and extending through said second connection at said opposite end of said cylindrical cavity; and first spring means disposed between said end of said cylindrical cavity and a first end of said piston and second spring means disposed between said opposite end of said cylindrical cavity and a second end of said piston for increasing pressure of said another source of hydraulic fluid relative to pressure of said source of hydraulic fluid.

13. The system of claim 1 wherein said pressurizing means comprises at least one hydraulic pump.

14. The system of claim 1 wherein a plurality of said accumulator means are coupled between said pressurizing means and said pulse generating means.

15. The system of claim 1 wherein said accumulator means has a plurality of connections coupled between at least one of said pressurizing means and said pulse generating means, and between said pulse generating means and said hydraulic fluid storage means for removing air and heat from a portion of said accumulator means.

16. The system of claim 1 further comprising:

housing means containing said pulse generating means, said actuator means, and said accumulator means and having a vibration dampening material thereon for reducing vibration external to said housing means; and said hydraulic fluid storage means and said pressurizing means being located external to said housing means.

17. A method of operating a pulse hydraulic system comprising the steps of:

providing hydraulic fluid storage means for supplying said system with hydraulic fluid;

providing pressurizing means coupled to said hydraulic fluid storage means for increasing pressure of said hydraulic fluid exiting from said hydraulic fluid storage means into said pressurizing means;

providing pulse generating means coupled to said pressurizing means for creating pulsed pressure of hydraulic fluid output therefrom;

providing actuator means having a plurality of lines connected to a top portion thereof from said pulse generating means and having another plurality of lines connected to a bottom portion thereof from said pulse generating means for doing work; and providing accumulator means coupled between at least one of said pressurizing means and said pulse generating means, between said pulse generating means and said actuator means, and between said pulse generating means and said hydraulic fluid storage means for storing and supplying pressurized hydraulic fluid to said system;

said accumulator means coupled between said pressurizing means and said pulse generating means being connected with a line from said pressurizing means within a portion of said pulse generating means.

18. The method of claim 17 wherein the step of providing said pulse generating means comprises the steps of:

providing cylindrical member means having a hollow, interior, cylindrical cavity and having a plurality of separate, grooved, exterior surface portions having a plurality of apertures there through for providing at least one chamber means for receiving hydraulic fluid from said pressurizing means, second chamber means for supplying said pulsed pressure hydraulic fluid to said actuator means, and third chamber means for returning said hydraulic fluid from said actuator means to said hydraulic fluid storage means via said pulse generating means;

providing rotor means inserted within said hollow, interior, cylindrical cavity and having a plurality of cavities on an exterior surface thereof for creating said pulsed pressure hydraulic fluid; and providing rotating means coupled to said rotor means for rotating said rotor means.

19. The method of claim 18 wherein the step of providing said actuator means comprises the steps of:

providing a housing;

providing a cylindrical cavity located within said housing;

providing a piston located within said cylindrical cavity and free to move along a lengthwise axis of said cylindrical cavity; and providing shaft means coupled to at least one side of said piston and extending from said housing for performing said work.

20. The method of claim 19 wherein at least one output from said pressurizing means is directly connected to said actuator means.

21. The method of claim 19 wherein said second and said third chamber means of said pulse generating means alternate both in providing said pulsed pressure hydraulic fluid to said actuator means and in returning said hydraulic fluid from said actuator means to said hydraulic fluid storage means.

22. The method of claim 18 wherein the step of providing said actuator means comprises the step of coupling a hydraulic motor with said pulse generating means.

23. The method of claim 18 wherein the step of providing said actuator means comprises the step of coupling at least one spray nozzle with said pulse generating means.

24. The method of claim 17 wherein the step of providing said accumulator means comprises the steps of:

providing a housing;

providing a cylindrical cavity located within said housing and having a connection at an end of said cavity to a source of hydraulic fluid;

providing a piston free to move along a lengthwise axis of said cylindrical cavity; and providing first spring means disposed between said end of said cylindrical cavity and a first end of said piston and second spring means disposed between a second end of said cylindrical cavity and a second end of said piston for permitting temporary storage of pressurized hydraulic fluid from said system and for returning said pressurized hydraulic fluid to said system.

25. The method of claim 24 wherein said second spring means comprises at least one of a spring and a bellville spring.

26. The method of claim 17 wherein the step of providing said accumulator means comprises the steps of:

providing a housing;

providing a cylindrical cavity located within said housing and having a connection at an end of said cavity to a source of hydraulic fluid;

providing a piston free to move along a lengthwise axis of said cylindrical cavity; and providing a plurality of spring means disposed between another end of said cylindrical cavity and an end of said piston for permitting temporary storage of pressurized hydraulic fluid from said system and for returning said pressurized hydraulic fluid to said system.

27. The method of claim 17 wherein the step of providing said pressurizing means comprises the step of providing at least one hydraulic pump.

28. The method of claim 17 wherein a plurality of said accumulator means are coupled between said pressurizing means and said pulse generating means.

29. The method of claim 17 wherein the step of providing said accumulator means comprises the steps of:

providing a housing;

providing a cylindrical cavity located within said housing and having a connection at an end of said cylindrical cavity to a source of hydraulic fluid;

providing a piston free to move along a lengthwise axis of said cylindrical cavity;

providing first spring means disposed between said end of said cylindrical cavity and a first side of said piston and a gas disposed within a cavity formed by said cylindrical cavity and a second side of said piston for permitting temporary storage of pressurized hydraulic fluid from said system and for returning said pressurized hydraulic fluid to said system; and providing over pressure relief means coupled to said cavity to prevent over pressurization of said cavity.

30. The method of claim 17 wherein the step of providing another of said accumulator means comprising pulse intensifier means comprises the steps of:

providing a housing;

providing a cylindrical cavity located within said housing and having a first connection at an end of said cavity to a source of hydraulic fluid and having a second connection at an opposite end of said cavity to another source of hydraulic fluid;

providing a piston free to move along a lengthwise axis of said cylindrical cavity;

providing a shaft having a smaller cross-sectional area than a cross-sectional area of said piston and said shaft being coupled to said piston and extending through said second connection at said opposite end of said cylindrical cavity; and providing first spring means disposed between said end of said cylindrical cavity and a first end of said piston and second spring means disposed between said opposite end of said cylindrical cavity and a second end of said piston for increasing pressure of said another source of hydraulic fluid relative to pressure of said source of hydraulic fluid.

* * * * *